US009478876B1

(12) United States Patent
Wang

(10) Patent No.: US 9,478,876 B1
(45) Date of Patent: Oct. 25, 2016

(54) CONDUCTIVE CLAMP FIXING STRUCTURE OF A SOCKET

(71) Applicant: Chuan-Sheng Wang, Tainan (TW)

(72) Inventor: Chuan-Sheng Wang, Tainan (TW)

( * ) Notice: Subject to any disclaimer, the term of this patent is extended or adjusted under 35 U.S.C. 154(b) by 0 days.

(21) Appl. No.: 14/743,355

(22) Filed: Jun. 18, 2015

(51) Int. Cl.
*H01R 24/00* (2011.01)
*H01R 4/48* (2006.01)

(52) U.S. Cl.
CPC ..... *H01R 4/4809* (2013.01)

(58) Field of Classification Search
CPC ..... H01R 13/68; H01R 4/4809
USPC ..... 439/660, 652, 650, 654, 214
See application file for complete search history.

(56) References Cited

U.S. PATENT DOCUMENTS 5,266,039 A * 11/1993 Boyer ..... H01R 13/648 439/107
7,081,009 B2 * 7/2006 Gorman ..... H01R 31/065 174/53
7,909,664 B2 * 3/2011 Ilkhanov ..... H01R 4/5008 439/107
8,968,039 B1 * 3/2015 Whipple ..... H01R 9/2408 439/814
9,246,242 B2 * 1/2016 Scanzillo ..... H01R 4/4818
9,257,798 B2 * 2/2016 Wang ..... H01R 13/68
2003/0236010 A1 * 12/2003 Gorman ..... H01R 31/065 439/107
2012/0115343 A1 * 5/2012 Plattner ..... H01R 13/11 439/214
2015/0064959 A1 * 3/2015 Wang ..... H01R 13/68 439/366
2015/0072564 A1 * 3/2015 Whipple ..... H01R 9/2408 439/651

FOREIGN PATENT DOCUMENTS

TW M477079 4/2014

* cited by examiner

*Primary Examiner* — Tulsidas C Patel
*Assistant Examiner* — Peter G Leigh
(74) *Attorney, Agent, or Firm* — Muncy, Geissler, Olds & Lowe, P.C.

(57) ABSTRACT

A conductive clamp fixing structure of a socket includes a seat and at least a conductive clamp. The seat is provided with a clamp fixing slot along an orthogonal direction, the clamp fixing slot is disposed at a position corresponding to a receptacle and a periphery of the clamp fixing slot is provided with a first fixing member. The conductive clamp is disposed in the clamp fixing slot and is provided with a second fixing member corresponding to the first fixing member. By assembling the second fixing member with the first fixing member, when a pin of a plug is pulled up, the conductive clamp can be fixed along the orthogonal direction, a longitudinal direction and a transversal direction, so that the conductive clamp will not displace relatively and cause pool contact by being subjected to the components of force resulted from inserting or pulling the plug.

13 Claims, 14 Drawing Sheets

CONDUCTIVE CLAMP FIXING STRUCTURE OF A SOCKET

BACKGROUND OF THE INVENTION (a) Field of the Invention

The present invention relates to a socket fixing structure which enables a conductive clamp to be tightly latched and fixed with a conducting plate, so that the conductive clamp will not displace relative to the conducting plate.

(b) Description of the Prior Art

For an ordinary socket, such as an adapter socket, an expansion socket and an extension cord socket, used for an electrical appliance, a circuit of the socket is usually connected with an overload protective device to prevent the circuit from the occurrence of current overload, overheat or fire. When the working temperature of the circuit is too high or the current is too large, the overload protective device can power off by high temperature to keep the safe use of electricity. However, each expansion socket and each extension cord socket are normally provided with plural socket units, wherein one socket unit is used for one plug and plural socket units share one overload protective device. Therefore, once the overload protective device powers off, all the socket units will power off, which will cause inconvenience in use. In addition, when all the socket units power off, a user is not able to know clearly which socket unit is in trouble, and even the user does know the socket unit that results in power-off, he or she will not be able to know whether it is due to the malfunction of the conductive clamp of the socket unit or it is due to the short circuit caused by the malfunction of the electrical appliance itself. Therefore, it is not very ideal to use these conventional socket units.

Accordingly, the present inventor has applied for a Taiwanese utility model patent publication No. M477079, "Overheat Failure Safety Structure, and a Socket and a Plug with the Overheat Failure Safety Structure," on Apr. 21, 2014. As shown in FIG. 17, this patent discloses a live wire terminal B which is extended with a live wire spring leaf B1, wherein an open-circuit position that is opened relatively is pre-built between the live wire spring leaf B1 and a live wire copper plate B2, and the live wire spring leaf B1 contacts with the live wire copper plate B2 by a stopper D between the two, thereby forming a closed path position and providing the live wire spring leaf B1 with an elastic restoring force. In addition, a neutral wire terminal C is extended with a neutral wire spring leaf C1, an open-circuit position that is opened relatively is pre-built between the neutral wire spring leaf C1 and a neutral wire copper plate C2, and the neutral wire spring leaf C1 contacts with the neutral wire copper plate C2 by another stopper D between the two, thereby forming a closed path position and providing the neutral wire spring leaf C1 with an elastic restoring force. Moreover, the live wire spring leaf B1 and the neutral wire spring leaf C1 are equipped with an elastic restoring force after bending the material of the spring leaves. This elastic restoring force allows the live wire spring leaf B1 to be opened relative to the live wire copper plate B2 when necessary to form the open-circuit state, and also enables the neutral wire spring leaf C1 to be opened relative to the neutral wire copper plate C2 when necessary to form the open-circuit state.

As the live wire copper plate B2 contacts with the live wire spring leaf B1 sufficiently by the tight clipping of the stopper D, and the neutral wire copper plate C2 also contacts with the neutral wire spring leaf C1 sufficiently by the tight clipping of another stopper D, the effect of electric conduction is good to reduce effectively the temperature resulted from turning on the current at that contact location. When any socket in the extension cord socket E is subjected to current overload, short circuit or circuit overheat, the working temperature at the contact location between the live wire copper plate B2 and the live wire spring leaf B1 or between the neutral wire copper plate C2 and the neutral wire spring leaf C1 will reach to the thermal deformation temperature (such as 120° C.), allowing the two stoppers D to be deformed and damaged by the thermal deformation temperature. At this time, the live wire spring leaf B1 will displace away from the live wire copper plate B2 by the abovementioned elastic restoring force, or the neutral wire spring leaf C1 will displace away from the neutral wire copper plate C2 by the abovementioned elastic restoring force, changing the contact location from the closed path position to the open-circuit position to stop supplying the current and prevent the working temperature from ascending continuously. As the two stoppers D are made of a non-conductive material, when the two stoppers D are deformed and damaged or even fractured into two parts by heat, the damaged stoppers D will never cause short circuit by contacting with peripheral electronic elements accidentally, so that the implementation can be safer.

The abovementioned conventional overheat failure safety structure can achieve the function of allowing the conductive clamps (i.e., the live wire terminal B and the neutral wire terminal C) of a receptacle of each socket unit to power off, without interfering with the normal power supply of the receptacles of other socket units. However, as the two conductive clamps are inserted by the pins of a plug, if there is no good fixing structure, the two conductive clamps can easily displace upon pulling or inserting the pins of the plug, allowing the contact surface between the two conductive clamps to result in sloshing, which can easily cause the stoppers D to get loose. Therefore, the improvement is needed.

SUMMARY OF THE INVENTION

Accordingly, to solve the abovementioned shortcoming that the conductive clamps of the socket cannot be fixed actually and completely when pulling or inserting the plug, the present invention discloses a conductive clamp fixing structure of a socket, which is disposed inside a receptacle of the socket, with a direction of the receptacle for inserting and pulling one pin of the plug being defined as the longitudinal direction, an orthogonal direction being defined to be perpendicular to the longitudinal direction and a transversal direction being defined to be perpendicular to both the longitudinal direction and the orthogonal direction. The conductive clamp fixing structure of the socket includes a seat and at least a conductive clamp, wherein the seat is provided with a clamp fixing slot along the orthogonal direction, the clamp fixing slot is disposed at a position corresponding to the receptacle, and a periphery of the clamp fixing slot is provided with a first fixing member. The conductive clamp is disposed in the clamp fixing slot and is provided with a second fixing member corresponding to the first fixing member. By assembling the second fixing member with the first fixing member, the conductive clamp can be fixed along the longitudinal direction, the orthogonal direction and the transversal direction when pulling or inserting the pin.

The abovementioned clamp fixing slot is provided with an orthogonal center line along the orthogonal direction, and the first fixing member is disposed at any side of the orthogonal center line.

There are more than two first fixing members, and the first fixing members are distributed at two sides of the orthogonal center line.

The abovementioned clamp fixing slot is provided with a transversal center line along the transversal direction, and the first fixing member is disposed at any side of the transversal center line.

There are more than two first fixing members, and the first fixing members are distributed at two sides of the transversal center line.

The abovementioned first fixing member is a slot hole extending along the longitudinal direction and the second fixing member is a plate body extending along the longitudinal direction. The maximum width of the plate body is physically equal to the width of the slot hole.

The abovementioned plate body is provided with a saw-tooth edge.

A side of the abovementioned seat is provided with at least a conducting plate fixing space which is disposed beside the clamp fixing slot.

Sides of the abovementioned seat are provided with plural first protective sheets and plural second protective sheets; whereas, a gap is disposed between the first protective sheet and the second protective sheet in the transversal direction to define the conducting plate fixing space.

The abovementioned conducting plate fixing space contains a conducting plate which is provided with a spring leaf. The spring leaf is provided with a free end, and the conductive clamp is provided with a contact end. The free end contacts with the contact end normally by the restraining and positioning of a stopper.

An interior of the abovementioned conducting plate fixing space is provided with at least a first locating piece, and the conducting plate is provided with at least a second locating piece which is fixed with the first locating piece correspondingly.

The abovementioned first locating piece is a fixture block, and the second locating piece is a fixture slot which is latched with the fixture block.

The abovementioned conducting plates serve as a live wire and a neutral wire respectively, and the conductive clamps are set up as a live wire conductive clamp and a neutral wire conductive clamp respectively.

The present invention is further provided with an outer housing to fix the seat. The outer housing is formed by combining an upper housing with a lower housing, the upper housing is provided with at least an opening, and the clamp fixing slot is provided with the receptacle corresponding to the opening.

In the present invention, plural seats are connected together to form an integrated structure which can be movably fixed in the outer housing.

The abovementioned seats are integrally formed on the upper housing.

The present invention is provided with following advantages that:

1. The sockets of the present invention can be tightly fixed together by the first fixing members of the clamp fixing slots and the second fixing members of the conductive clamps. The conductive clamps and the conducting plates will not be subjected to the component of force formed when pulling or inserting the plug; therefore, the contact end will not displace relative to the free end that the two ends will not contact poorly or get loose.
2. The first fixing member of the present invention is disposed at any side or two sides of the orthogonal center line or any side or two sides of the transversal center line of the clamp fixing slot, wherein the abovementioned "any-side" distribution method is provided with an effect of assisting the conductive clamp to be positioned stably, and the abovementioned "two-side" distribution method can further distribute fixing points evenly. Therefore, the conductive clamp can have a good fixing effect to compensate for the components of force sufficiently while pulling or inserting the plug.
3. The socket of the present invention fits with the latching and fixing of the second locating piece of the conducting plate with the first locating piece in the conducting plate fixing space, so that the conductive clamp and the conducting plate can be more tightly latched and fixed, without being subjected to the components of force resulted from pulling or inserting the plug that the contact end will displace relative to the free end.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
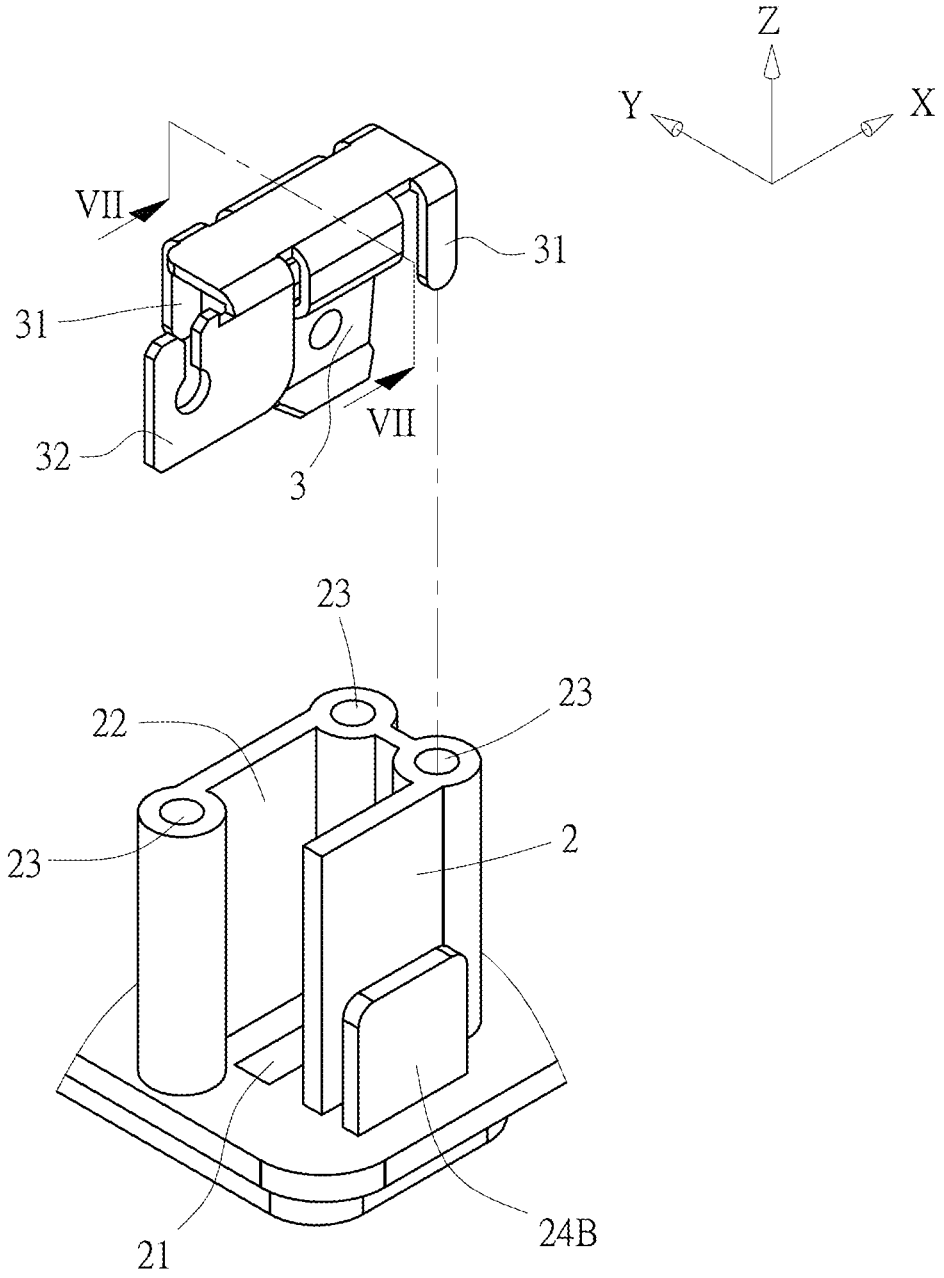
FIG. 1 shows a local enlarged schematic view of a seat and a conductive clamp of the present invention.
Figure 2:
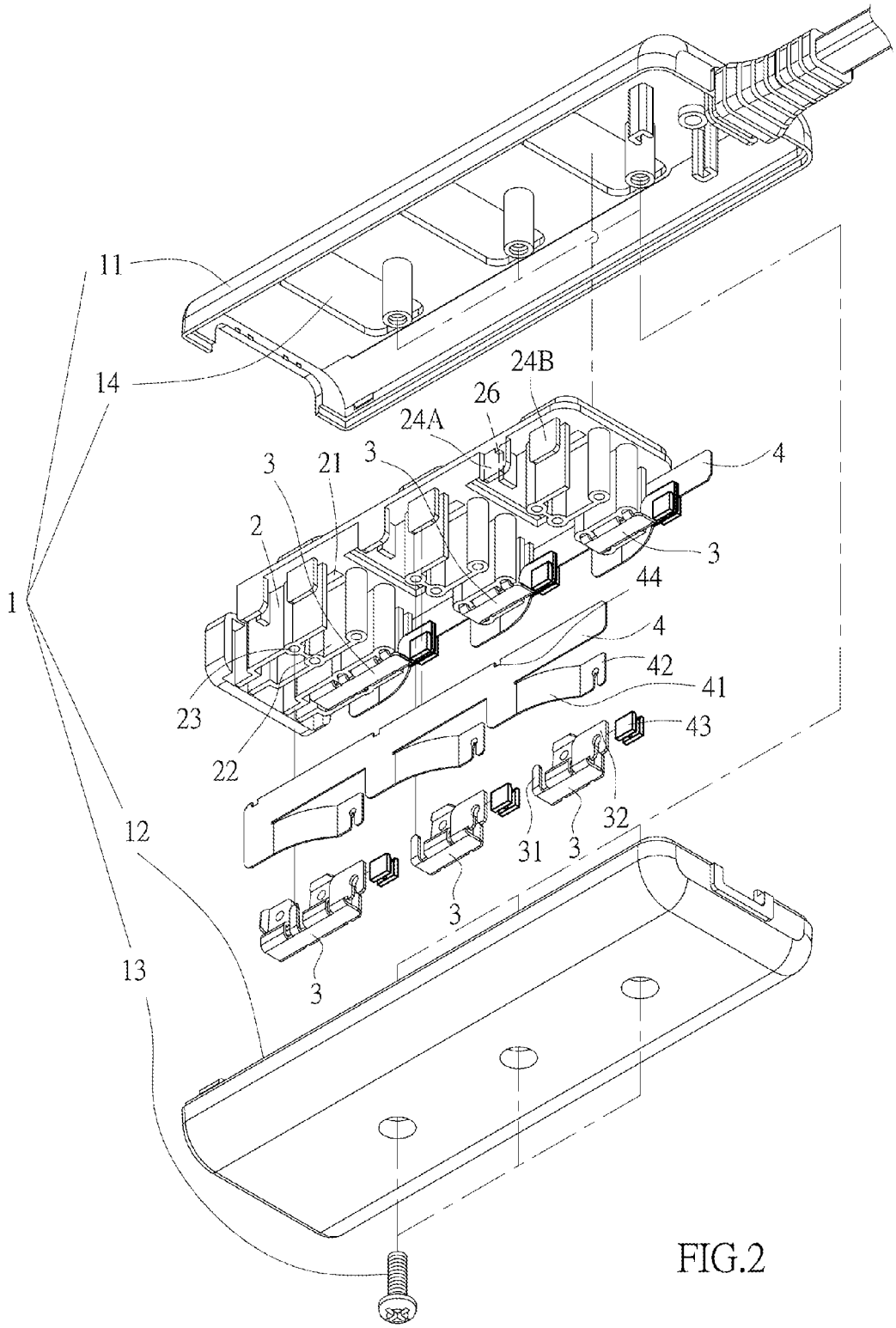
FIG. 2 shows a three-dimensional exploded view of the present invention.
Figure 3:
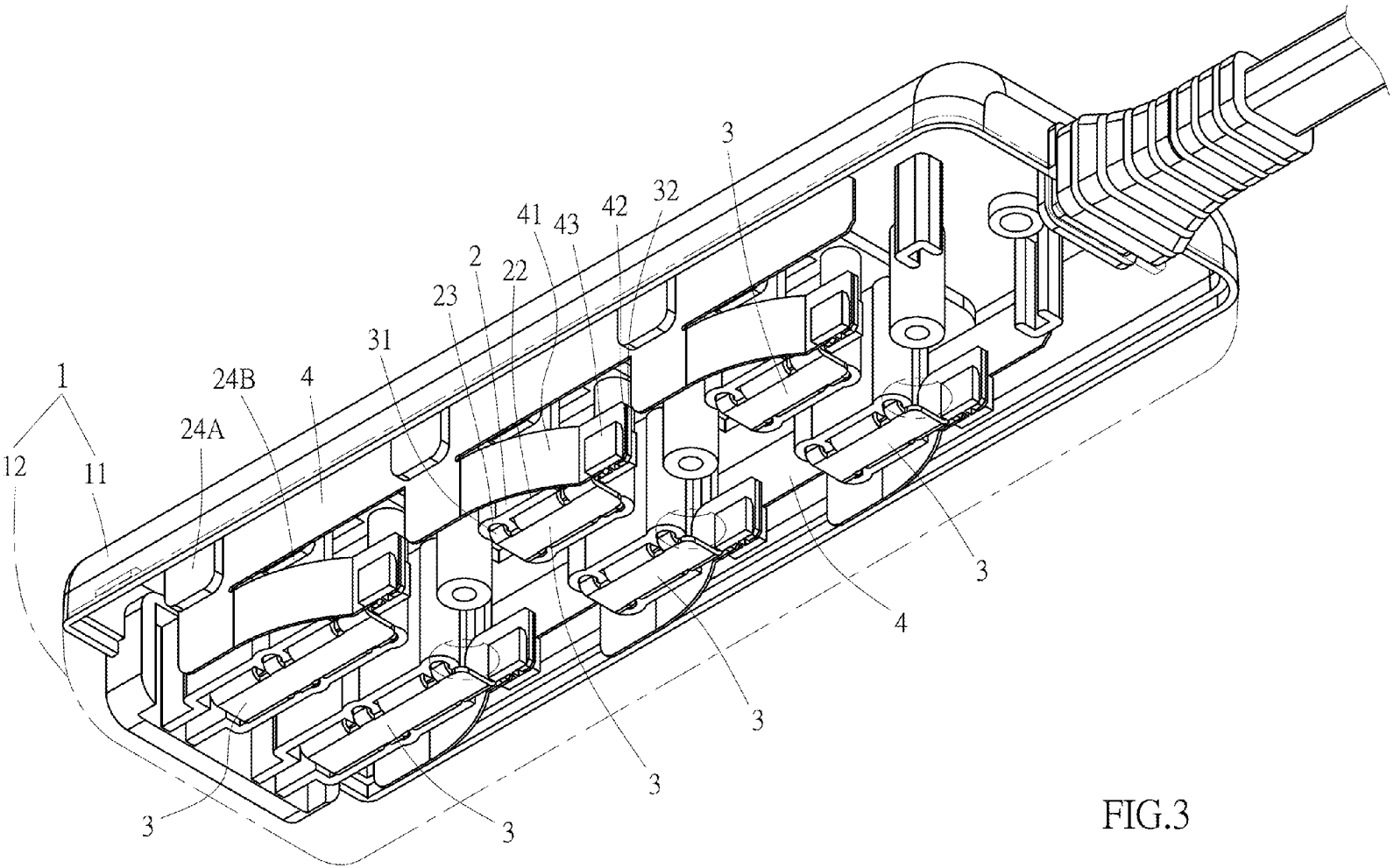
FIG. 3 shows a three-dimensional assembly view of the present invention.
Figure 4:
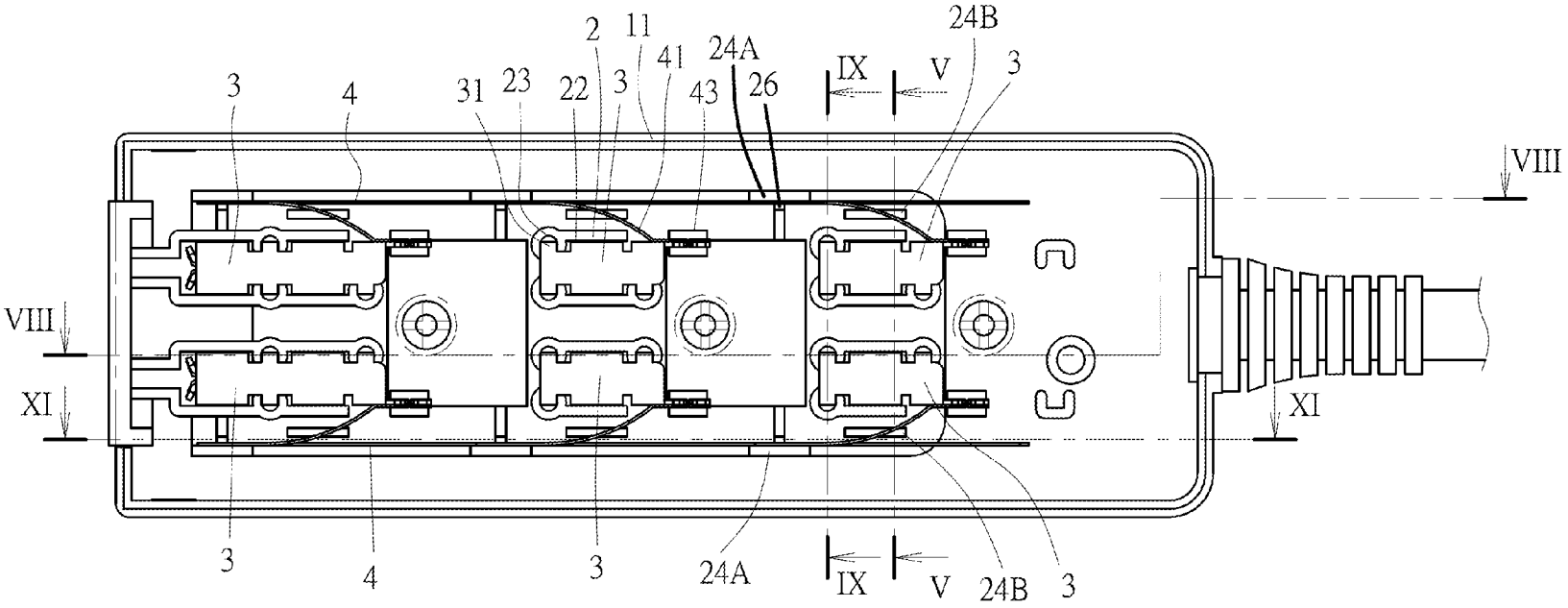
FIG. 4 shows a plan view of an internal of the present invention, after accomplishing the assembly.

In the embodiment described hereinafter, only one of the several identical parts is marked with symbols, with the rest of the same parts being shown without the symbols, to facilitate viewing the drawings. An extension cord socket is used as an example in the following embodiment. Referring to FIG. 1 and FIG. 2, the present embodiment comprises an outer housing 1, at least a seat 2, conductive clamp 3 and conducting plate 4.

Referring to FIG. 2, the outer housing 1 is formed by assembling an upper housing 11 with a lower housing 12 by screw elements 13. The upper housing 11 is provided with at least an opening 14.

Referring to FIG. 1, FIG. 2, FIG. 5 and FIG. 6, the seat 2 is fixed in the outer housing 1 or can be integrally formed on the upper housing 11 of the outer housing 1. In the present embodiment, plural seats 2 are connected together to form an integrated structure which can be movably fixed in the outer housing 1. The seat 2 is provided with at least a receptacle 21 corresponding to the abovementioned opening 14, and the receptacle 21 provides for the insertion of a pin A1 of a plug A). The direction along which the pin A1 is inserted and pulled is defined as a longitudinal direction Z, an orthogonal direction X is defined to be perpendicular to the longitudinal direction Z, and a transversal direction Y is defined to be perpendicular to both the longitudinal direction Z and the orthogonal direction X. The seat 2 is provided with a clamp fixing slot 22 along the orthogonal direction X, and the clamp fixing slot 22 is disposed at a position corresponding to the receptacle 21. A periphery of the clamp fixing slot 22 is provided with at least a first fixing member 23 which is a slot hole extending along the longitudinal direction Z. Sides of the seat 2 are provided with plural first protective sheets 24A and plural second protective sheets 24B, wherein a gap is disposed between the first protective sheet 24A and the second protective sheet 24B in the transversal direction Y, thereby defining a conducting plate fixing space 25. The conducting plate fixing space 25 is disposed beside the clamp fixing slot 22, and an interior of the conducting plate fixing space 25 is provided with at least a first locating piece 26 which is a fixture block.

Referring to FIG. 1, FIG. 5, FIG. 7, FIG. 8 and FIG. 9, the conductive clamp 3 is disposed in the clamp fixing slot 22 and is provided with at least a second fixing member 31 which fits with the first fixing member 23. The second fixing member 31 is a plate body extending along the longitudinal direction Z, and the maximum width of the plate body is physically equal to the width of the slot hole (i.e., the first fixing member 23). By assembling the second fixing member 31 with the first fixing member 23, the conductive clamp 3 can be fixed along the longitudinal direction Z, the orthogonal direction X and the transversal direction Y, while inserting or pulling the pin A1 of the plug A. In addition, the conductive clamp 3 is provided with a contact end 32.

Referring to FIG. 4, FIG. 6, FIG. 10 and FIG. 11, the conducting plate 4 is contained in the conducting plate fixing space 25 and is provided with plural spring leaves 41. The spring leaf 41 includes a free end 42 which attaches and contacts with the contact end 32 normally by the restraining and positioning of a stopper 43. In the present embodiment, there are two conducting plates 4 which serve as a live wire and a neutral wire respectively. The present embodiment includes six conductive clamps 3, three of which serve as the live wire conductive clamps, and three of which serve as the neutral wire conductive clamps. The conductive clamp 4 is provided with at least a second locating piece 44 which is fixed with the first locating piece 26 in the conducting plate fixing space 25 correspondingly. The second locating piece 44 is a fixture slot latched with the first locating piece 26.

Referring to FIG. 2, FIG. 3, FIG. 6, FIG. 8, FIG. 10 and FIG. 11, upon assembling, six conductive clamps 3 are put into the clamp fixing slot 22 of the seat 2 respectively. The second fixing members 31 of the conductive clamp 3 are then latched into the first fixing members 23 of the clamp fixing slot 22 one by one, so that the second fixing members 31 can be fixed and latched with the first fixing members 23 without displacing relative to each other. The two conducting plates 4 are put into the two conducting plate fixing spaces 25 defined by the first protective sheets 24A and the second protective sheets 24B respectively, and the second locating pieces 44 of the two conducting plates 4 are latched into the first locating pieces 26 of the two conducting plate fixing spaces 25 one by one, so that the second locating pieces 44 can be latched with the first locating pieces 26 without displacing relative to each other. Next, the contact end 32 of the conductive clamp 3 attaches and contacts with the free end 42 of the spring leaf 41 of the conducting plate 4, followed by being clipped and fixed by the insulative stopper 43, so that the contact end 32 can contact with the free end 42 tightly. The stopper 43 will be damaged under a certain working temperature; for example, it will be melted and fractured or deformed between 80° C. and 160° C. By using the two conducting plates 4 as the live wire and the neutral wire respectively, the conductive clamps 3 can become the corresponding live wire conductive clamp and the neutral wire conductive clamp respectively. Finally, the upper housing 11 and the lower housing 12 are assembled together by the screw elements 13.

Figure 5:
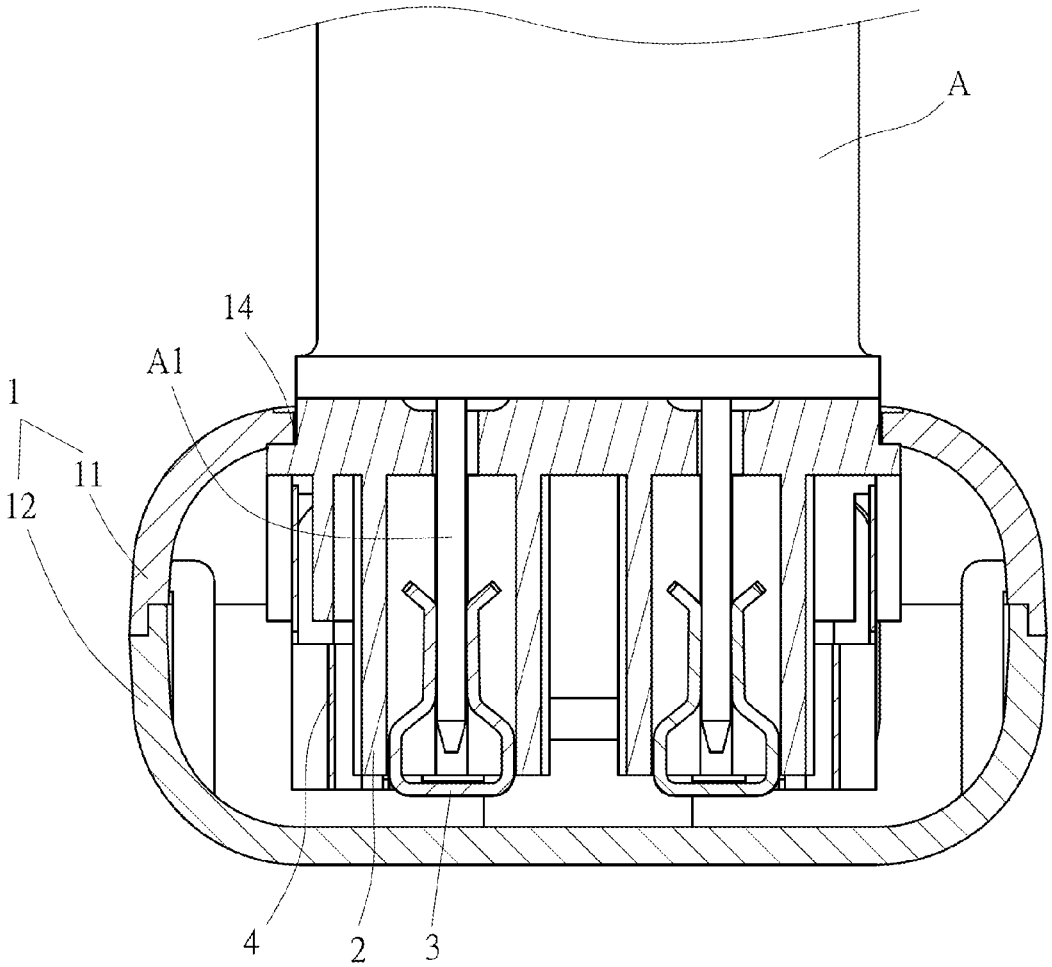
FIG. 5 shows a schematic view of a use for insertion with a plug, along a V-V cross section in FIG. 4.
Figure 6:
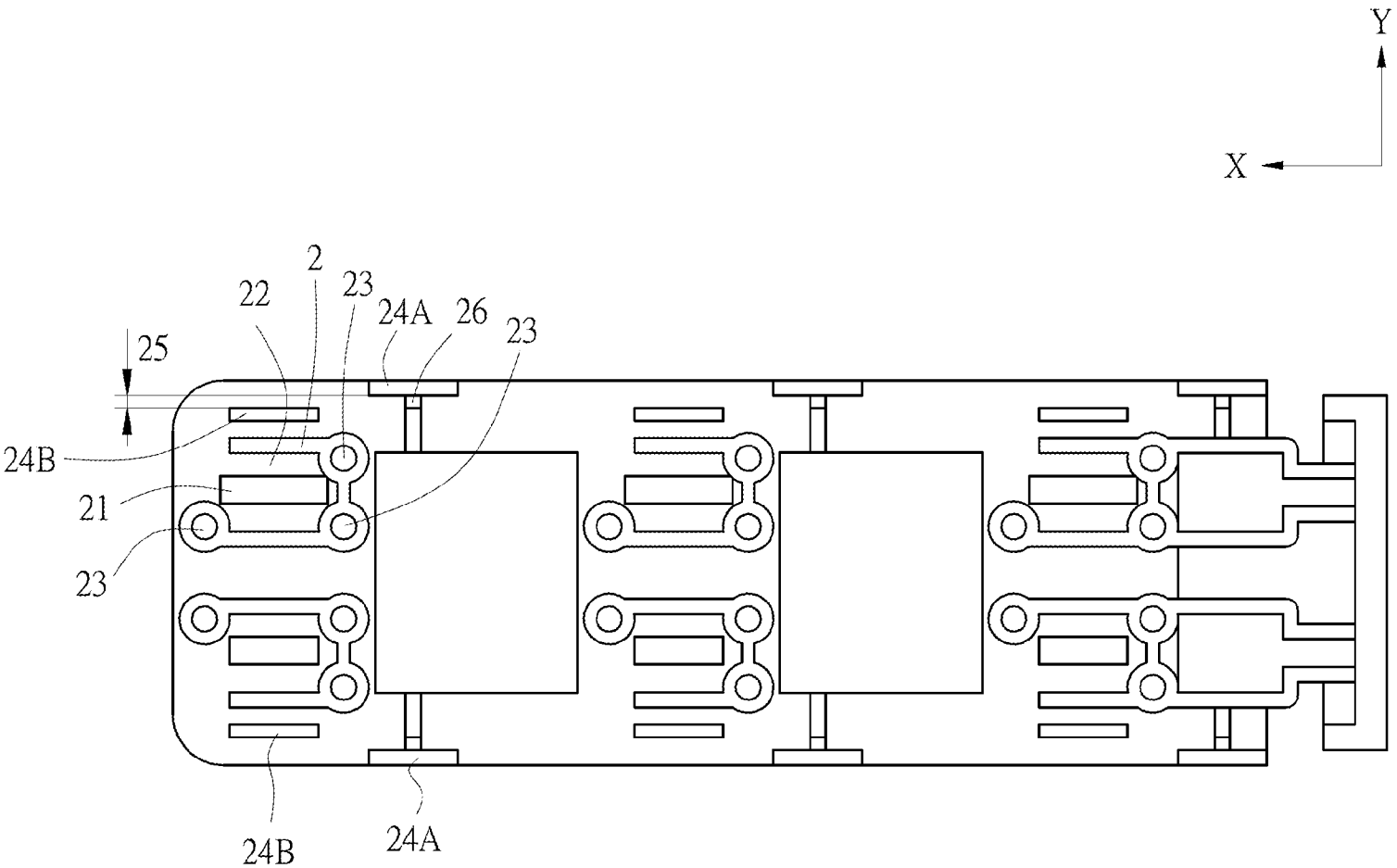
FIG. 6 shows a schematic view of defining a conducting plate fixing space by plural first protective sheets and plural second protective sheets, according to the present invention.
Figure 7:
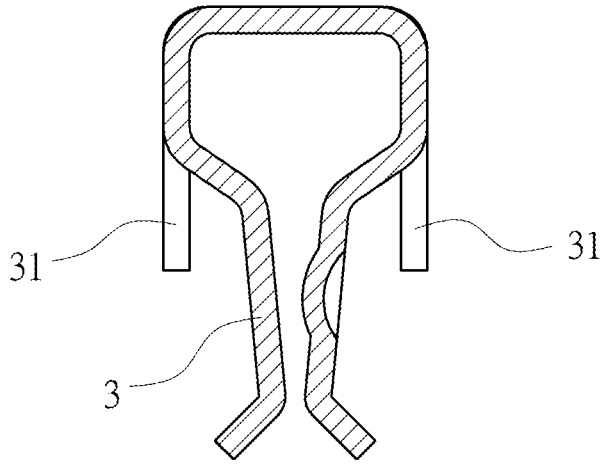
FIG. 7 shows a schematic view of fixing the conducting plate at the seat, along a VII-VII cross section in FIG. 1.

Accordingly, referring to FIG. 1, FIG. 5, FIG. 6, FIG. 8, FIG. 10 and FIG. 11, when the plug A is to be inserted for use, as shown in FIG. 5, the pin A1 of the plug A is inserted into the conductive clamp 3 from the opening 14 of the upper housing 11, thereby forming an electric loop. When inserting or pulling the pin A1 of the plug A, the force of insertion or pulling may not be perpendicular to the longitudinal direction Z completely. Therefore, the components of force along the longitudinal direction Z, the orthogonal direction X and the transversal direction Y will be formed on the conductive clamp 3 and the conducting plate 4 by the force of insertion or pulling. However, the component of force along the longitudinal direction Z, the component of force along the orthogonal direction X, and the component of force along the transversal direction Y can be compensated for completely by tightly latching and fixing the first fixing member 23 of the clamp fixing slot 22 with the second fixing member 31 of the conductive clamp 3. In addition, by latching and fixing the second locating piece 44 of the conducting plate 4 with the first locating piece 26 of the conducting plate fixing space 25, the conductive clamp 3 and the conducting plate 4 will not be subjected to all the components of force resulted from inserting or pulling the pin A1 of the plug A that the contact end 32 will displace relative to the free end 42 to get loose. Therefore, the abnormal temperature rise caused by poor contact and the fire caused by high temperature can be avoided.

Figure 10:
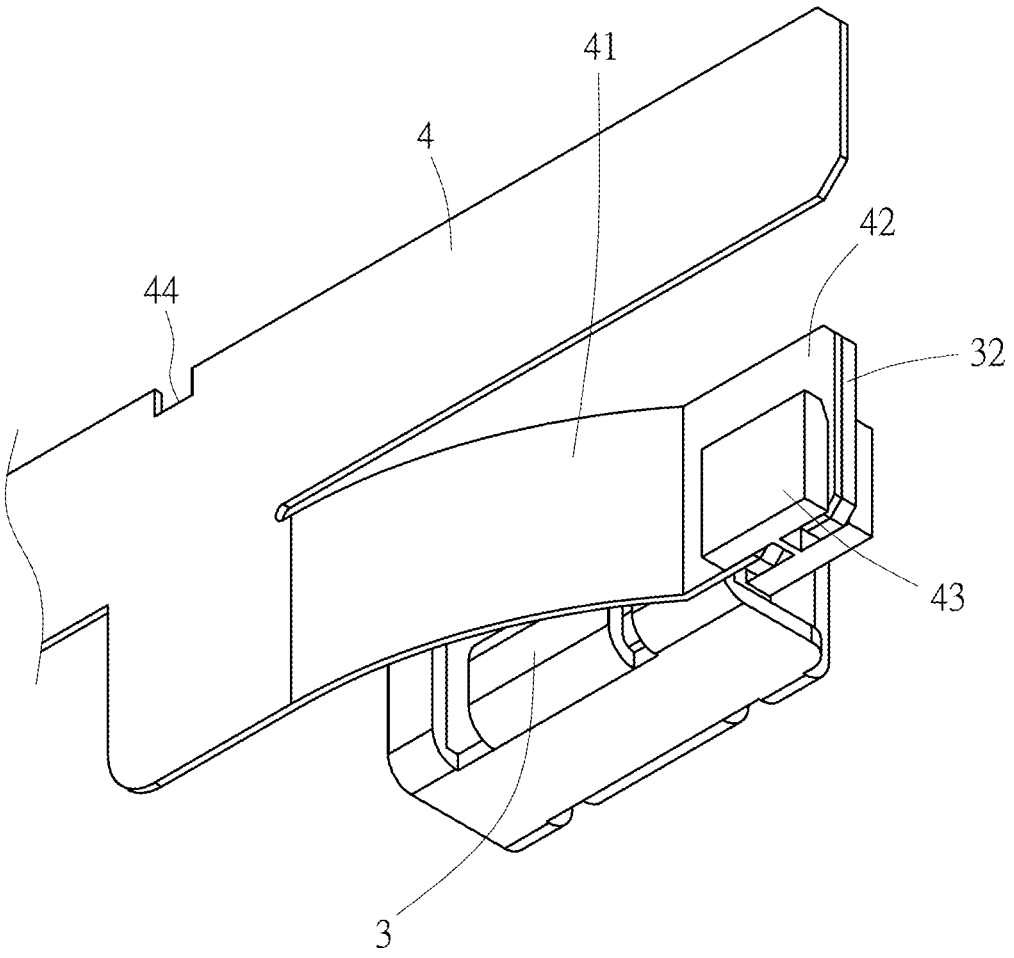
FIG. 10 shows a schematic view of that a stopper clips and fixes a contact end with a free end, according to the present invention.
Figure 11:
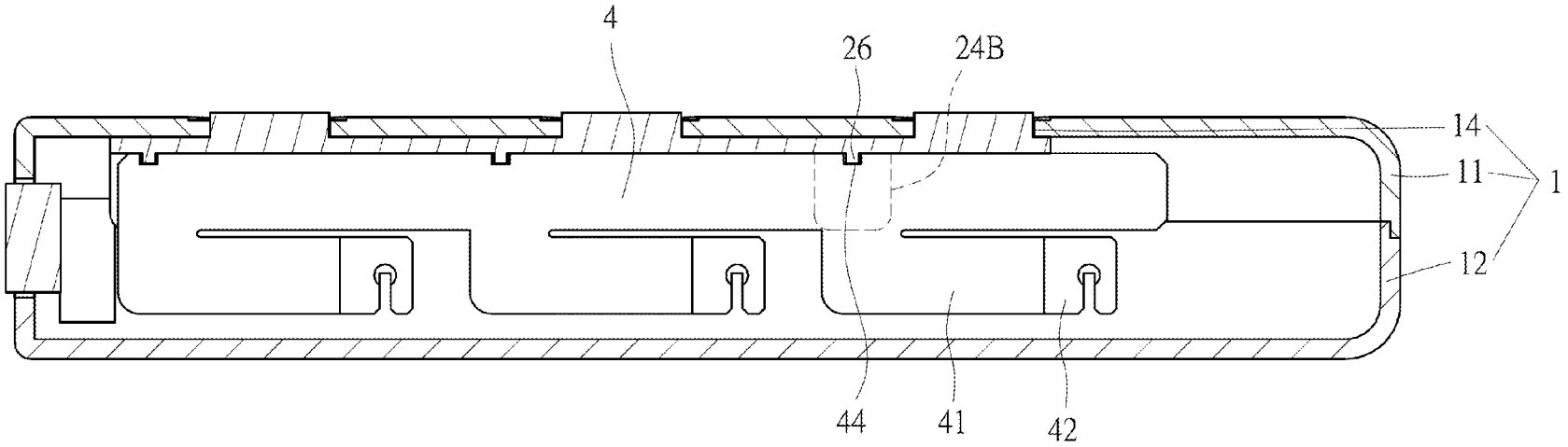
FIG. 11 shows a schematic view of latching and fixing a second locating piece with a first locating piece, along a XI-XI cross section in FIG. 4.

Referring to FIG. 5 and FIG. 10, when the loop constituted by the live wires and the neutral wires malfunctions, such as too large a load or poor contact between the pin A1 and the conductive clamp 3, the temperature of the live wires or the neutral wires will rise up abnormally. In addition, the temperature rise at the contact end 32 of the conductive clamp 3 and the free end 42 of the conducting plate 4 will melt fracture or deform the stopper 43. At this time, the free end 42 of the conducting plate 4 is no longer clipped and fixed by the stopper 43, and the free end 42 can eject from and separate with the contact end 32 of the conductive clamp 3 quickly by the elastic force of the spring leaf 41 itself, thereby forming an open-circuit state to assure the safety of use.

Figure 12:
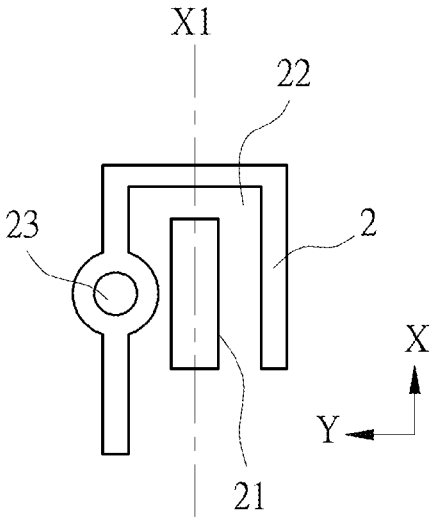
FIG. 12 shows a schematic view of that a first fixing member is disposed at any side of an orthogonal center line, according to the present invention.

Furthermore, referring to FIG. 12, the clamp fixing slot 22 is provided with an orthogonal center line X1 along the orthogonal direction X. In the present embodiment, the orthogonal center line X1 passes through the center of the receptacle 21 of the seat 2, and when there is one first fixing member 23, the first fixing member 23 is disposed at any side of the orthogonal center line X1.

Figure 13:
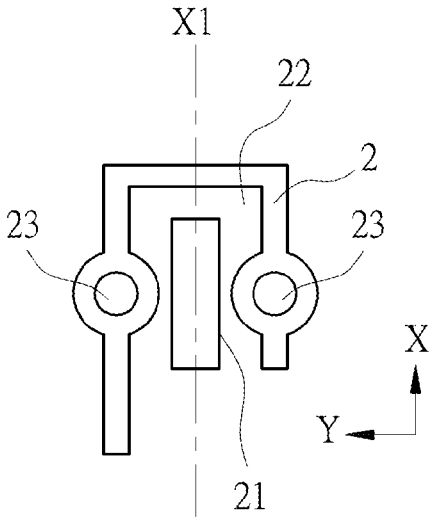
FIG. 13 shows a schematic view of that two first fixing members are disposed at two sides of the orthogonal center line, according to the present invention.

Referring to FIG. 13, the clamp fixing slot 22 is provided with an orthogonal center line X1 along the orthogonal direction X. In the present embodiment, the orthogonal center line X1 passes through the center of the receptacle 21 of the seat 2, and when there are more than two first fixing members 23, the first fixing members 23 are distributed at two sides of the orthogonal center line X1, respectively.

Figure 14:
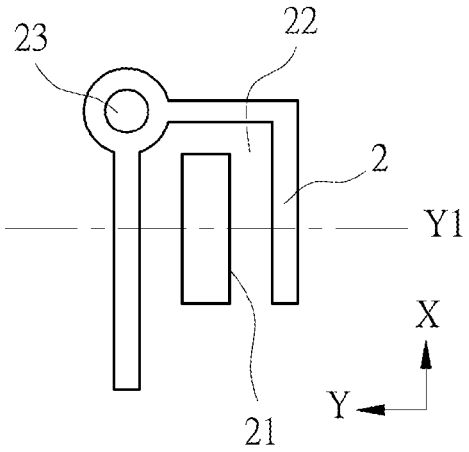
FIG. 14 shows a schematic view of that a first fixing member is disposed at any side of a transversal center line, according to the present invention.

Furthermore, referring to FIG. 14, the clamp fixing slot 22 is provided with a transversal center line Y1 along the transversal direction Y. In the present embodiment, the transversal center line Y1 passes through the center of the receptacle 21 of the seat 2, and when there is one first fixing member 23, the first fixing member 23 is disposed at any side of the transversal center line Y1.

Figure 15:
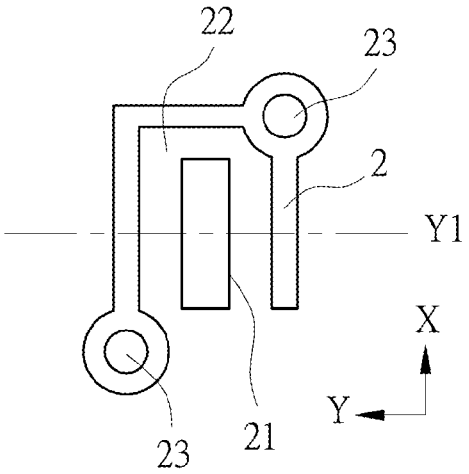
FIG. 15 shows a schematic view of that two first fixing members are disposed at two sides of the transversal center line, according to the present invention.

Referring to FIG. 15, the clamp fixing slot 22 is provided with a transversal center line Y1 along the transversal direction Y. In the present embodiment, the transversal center line Y1 passes through the center of the receptacle 21 of the seat 2, and when there are more than two first fixing members 23, the first fixing members 23 are distributed at two sides of the transversal center line Y1, respectively.

Figure 8:
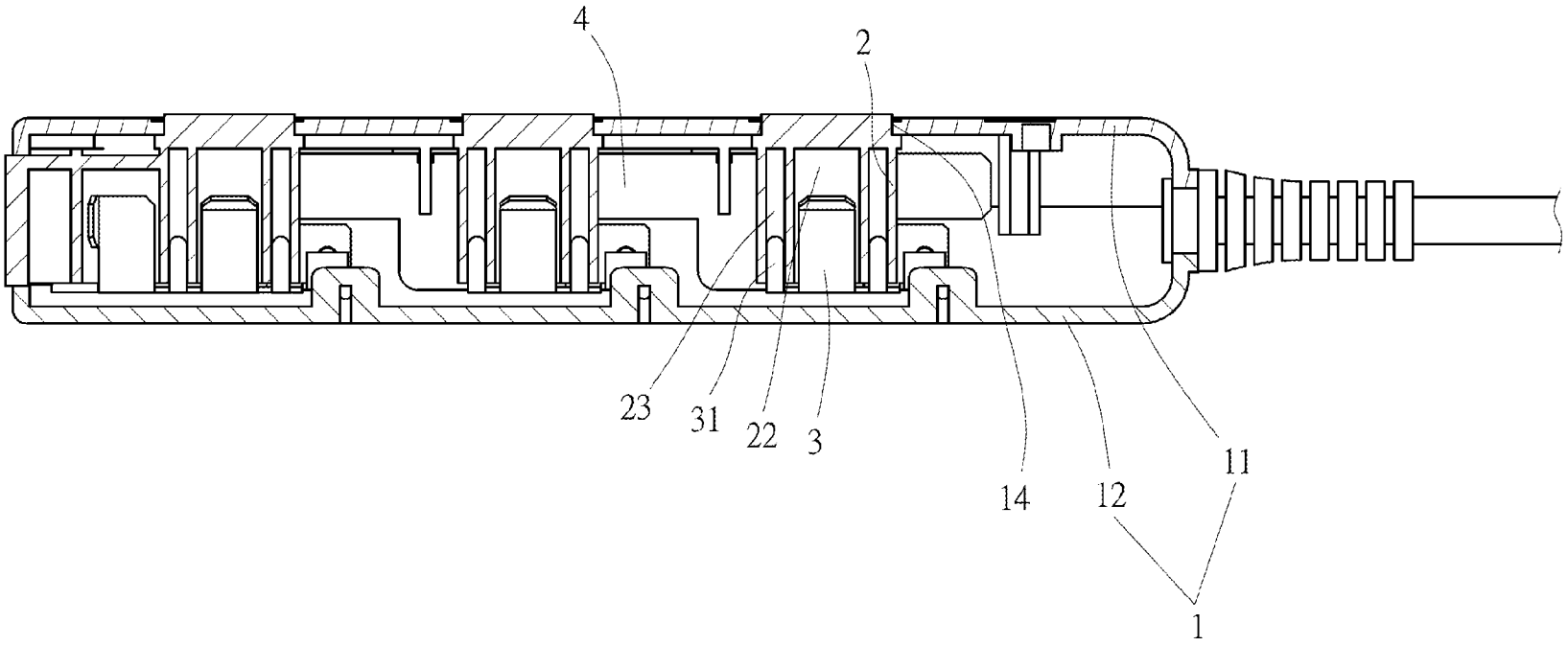
FIG. 8 shows a schematic view of latching and fixing a first fixing member with a second fixing member, along a VIII-VIII cross section in FIG. 4.
Figure 9:
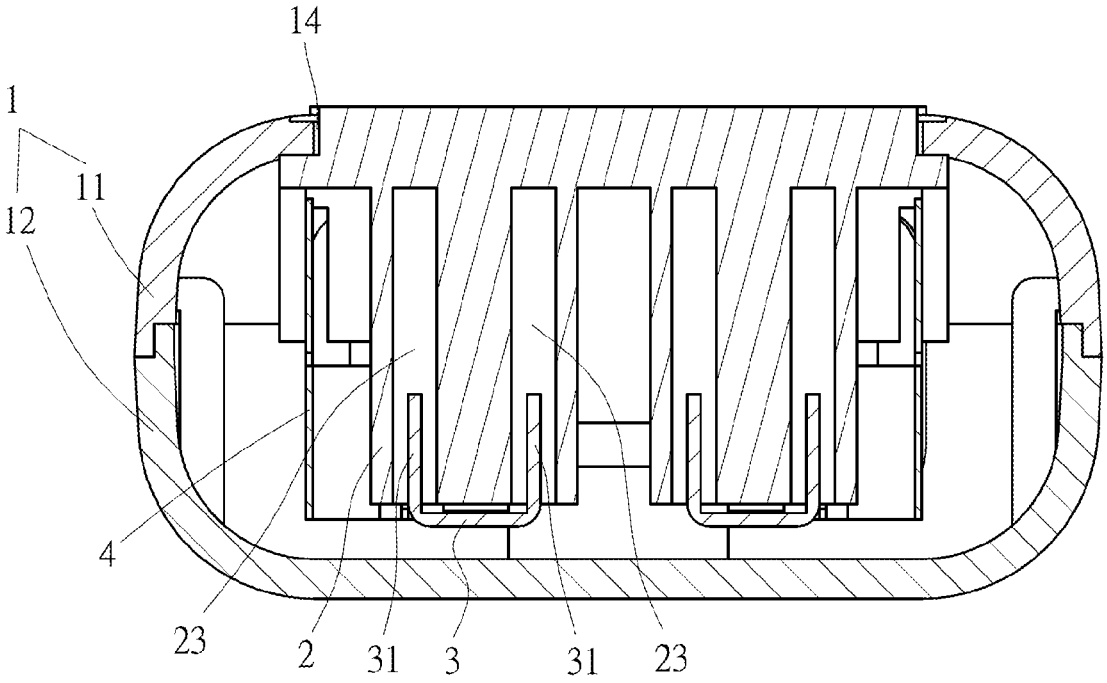
FIG. 9 shows a schematic view of fixing the conductive clamp at the seat, along a IX-IX cross section in FIG. 4.
Figure 16:
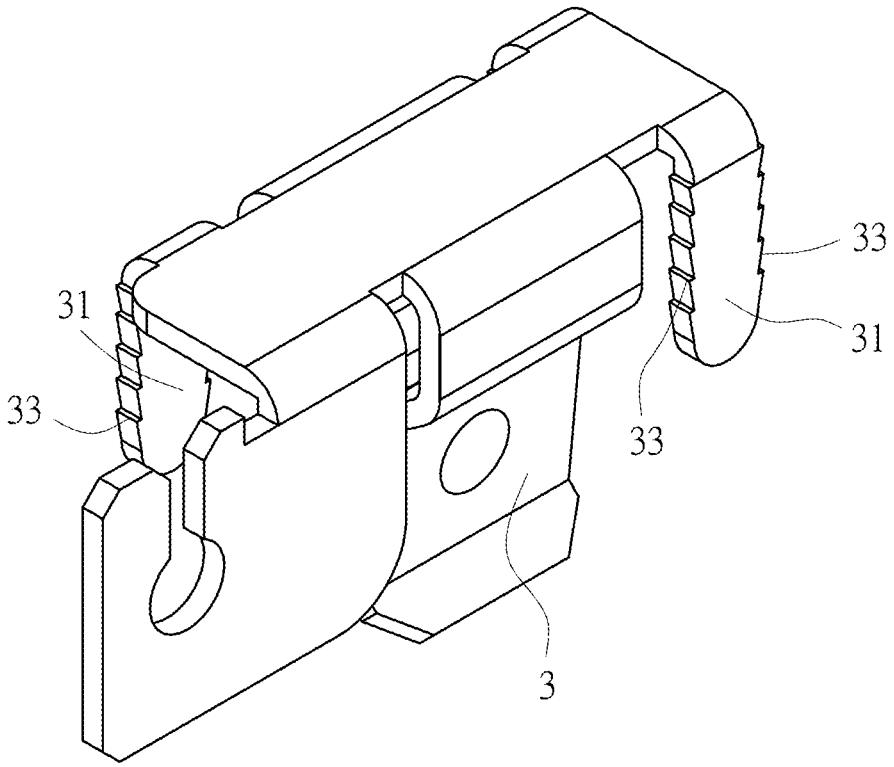
FIG. 16 shows a schematic view of that a second fixing member is a plate body with a sawtooth edge, according to the present invention.
Figure 17:
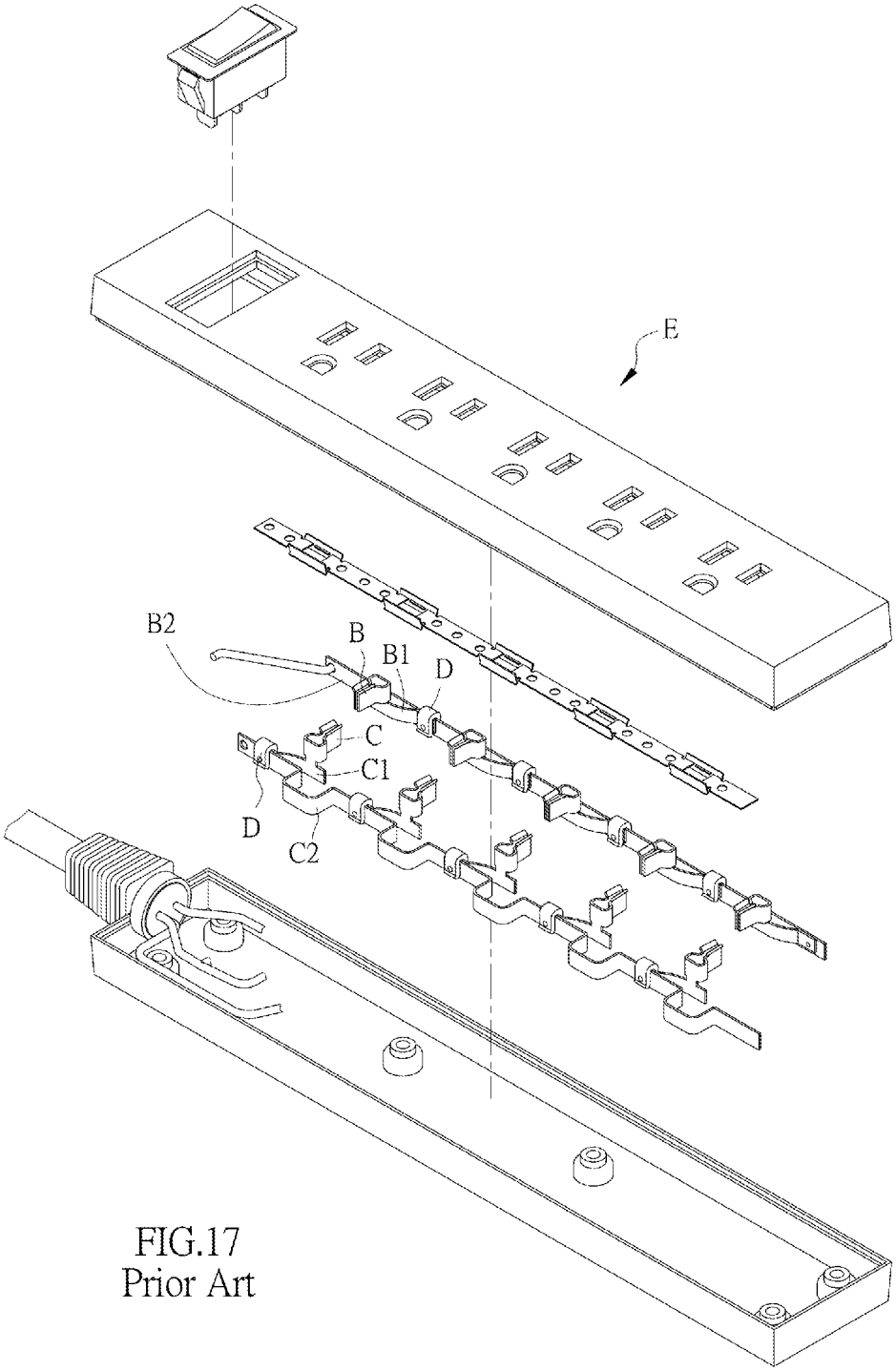
FIG.17 Prior Art
FIG. 17 shows a three-dimensional exploded view of the Taiwanese utility model patent No. M477079, "Socket with an Overheat Failure Safety structure."

In addition, referring to FIG. 8 and FIG. 16, the second fixing member 31 of the conductive clamp 3, is a plate body with a sawtooth edge 33, so that the second fixing member 31 can be assembled with the first fixing member 23 of the seat 2 stably.

It is to be understood that the above description and drawings are only used for illustrating some embodiments of the present invention, not intended to limit the scope thereof. Any variation and deviation from the above description and drawings should be included in the scope of the present invention.

What is claimed is:

1. An assembly of conductive clamp and fixing structure of a socket, with a direction along which a pin of a plug is inserted into and pulled out of the receptacle being defined as a longitudinal direction, an orthogonal direction being defined to be perpendicular to the longitudinal direction, and a transversal direction being defined to be perpendicular to both the longitudinal direction and the orthogonal direction, the conductive clamp fixing structure of the socket comprising:

a seat, the seat being provided with a clamp fixing slot along the orthogonal direction, with the clamp fixing slot being disposed at a position corresponding to the receptacle and a periphery of the clamp fixing slot being provided with a first fixing member, a side of the seat is provided with a conducting plate fixing space which is disposed beside the clamp fixing slot, the conducting plate fixing space is provided with a first locating piece;

a conductive plate, the conducting plate is contained in the conducting plate fixing space and is provided with spring leaf, the spring leaf includes a free end, the spring leaf is provided with a free end, the conductive clamp is provided with a contact end, and the free end contacts with the contact end normally by restraining and positioning of a stopper, and the conducting plate is provided with a second locating piece which is fixed with the first locating piece correspondingly; and a conductive clamp, the conductive clamp being disposed in the clamp fixing slot and being provided with a second fixing member, with the second fixing member corresponding to the first fixing member;

by assembling the second fixing member with the first fixing member, the conductive clamp being fixed along the longitudinal direction, the orthogonal direction and the transversal direction while inserting and pulling the pin.

2. The assembly of conductive clamp and fixing structure of a socket, according to claim 1, wherein the clamp fixing slot is provided with an orthogonal center line along the orthogonal direction and the first fixing member is disposed at any side of the orthogonal center line.

3. The assembly of conductive clamp and fixing structure of a socket, according to claim 2, wherein there are more than two first fixing members which are distributed at two sides of the orthogonal center line.

4. The assembly of conductive clamp and fixing structure of a socket, according to claim 1, wherein the clamp fixing slot is provided with a transversal center line along the transversal direction and the first fixing member is disposed at any side of the transversal center line.

5. The assembly of conductive clamp and fixing structure of a socket, according to claim 4, wherein there are more than two first fixing members which are distributed at two sides of the transversal center line.

6. The assembly of conductive clamp and fixing structure of a socket, according to claim 1, wherein the first fixing member is a slot hole extending along the longitudinal direction, the second fixing member is a plate body extending along the longitudinal direction, and maximum width of the plate body is physically equal to width of the slot hole.

7. The assembly of conductive clamp and fixing structure of a socket, according to claim 6, wherein the plate body is provided with a sawtooth edge.

8. The assembly of conductive clamp and fixing structure of a socket, according to claim 1, wherein sides of the seat are provided with plural first protective sheets and plural second protective sheets, and a gap is disposed between the first protective sheet and the second protective sheet in the transversal direction, thereby defining the conducting plate fixing space.

9. The assembly of conductive clamp and fixing structure of a socket, according to claim 1, wherein the first locating piece is a fixture block and the second locating piece is a fixture slot which is latched with the fixture block.

10. The assembly of conductive clomp and fixing structure of a socket, according to claim 1, wherein the conducting plates serve as a live wire and a neutral wire respectively, and the conductive clamps are set up as a live wire conductive clamp and a neutral wire conductive clamp respectively.

11. The assembly of conductive clamp and fixing, structure of a socket, according to claim 1, further including an outer housing to fix the seat, with the outer housing being formed by combining an upper housing with a lower housing, the upper housing being provided with an opening, and the clamp fixing slot being provided with a receptacle corresponding to the opening.

12. The assembly of conductive clamp and fixing structure of a socket, according to claim 11, wherein plural seats are connected together to form an integrated structure which is movably fixed in the outer housing.

13. The assembly of conductive clamp and fixing structure of a socket, according to claim 11, wherein the seats are integrally formed on the upper housing.

* * * * *